US008066552B2

(12) United States Patent
Duboust et al.

(10) Patent No.: US 8,066,552 B2
(45) Date of Patent: Nov. 29, 2011

(54) MULTI-LAYER POLISHING PAD FOR LOW-PRESSURE POLISHING

(75) Inventors: Alain Duboust, Sunnyvale, CA (US); Shou-Sung Chang, Los Altos, CA (US); Wei Lu, Fremont, CA (US); Siew Neo, Santa Clara, CA (US); Yan Wang, Sunnyvale, CA (US); Antoine P. Manens, Mountain View, CA (US); Yongsik Moon, Sunnyvale, CA (US)

(73) Assignee: Applied Materials, Inc., Santa Clara, CA (US)

( * ) Notice: Subject to any disclaimer, the term of this patent is extended or adjusted under 35 U.S.C. 154(b) by 894 days.

(21) Appl. No.: 11/043,361

(22) Filed: Jan. 26, 2005

(65) Prior Publication Data

US 2005/0221723 A1 Oct. 6, 2005

Related U.S. Application Data

(63) Continuation-in-part of application No. 10/956,617, filed on Oct. 1, 2004, and a continuation-in-part of application No. 10/773,868, filed on Feb. 6, 2004, now abandoned.

(60) Provisional application No. 60/508,321, filed on Oct. 3, 2003.

(51) Int. Cl.
*B24B 29/00* (2006.01)

(52) U.S. Cl. ..... 451/288; 451/290; 451/527; 451/533; 451/540

(58) Field of Classification Search ..... 451/36, 451/41, 59, 63, 288, 290, 527, 533, 539, 451/548, 550
See application file for complete search history.

(56) References Cited

U.S. PATENT DOCUMENTS

| | | | | |
|---|---|---|---|---|
| 3,499,250 | A | 3/1970 | Jensen et al. | |
| 3,504,457 | A | 4/1970 | Jacobsen et al. | |
| 4,512,113 | A | 4/1985 | Budinger | |
| 4,839,206 | A * | 6/1989 | Waldenberger | 428/41.5 |
| 4,879,258 | A | 11/1989 | Fisher | |
| 4,927,485 | A | 5/1990 | Cheng et al. | |
| 5,081,796 | A | 1/1992 | Schultz | |
| 5,177,908 | A | 1/1993 | Tuttle | |
| 5,196,353 | A | 3/1993 | Sandhu et al. | |
| 5,257,478 | A | 11/1993 | Hyde et al. | |
| 5,297,364 | A | 3/1994 | Tuttle | |

(Continued)

FOREIGN PATENT DOCUMENTS

JP 57-138575 8/1982

(Continued)

OTHER PUBLICATIONS

U.S. Appl. No. 10/980,888, Assignee, Applied Materials, Inc.

(Continued)

*Primary Examiner* — Timothy V Eley
(74) *Attorney, Agent, or Firm* — Fish & Richardson P.C.

(57) ABSTRACT

A polishing pad has a polishing layer and a backing layer secured to the polishing layer. The polishing layer has a polishing surface, a first thickness, a first compressibility, and a hardness between about 40 to 80 Shore D. The backing layer has a second thickness and has a second compressibility greater than the first compressibility. The first thickness, first compressibility, second thickness and second compressibility are such that the polishing surface deflects more than the thickness non-uniformity of the polishing layer under an applied pressure of 1.5 psi or less.

31 Claims, 4 Drawing Sheets

U.S. PATENT DOCUMENTS 5,329,734 A 7/1994 Yu
5,413,941 A 5/1995 Koos et al.
5,433,651 A 7/1995 Lustig et al.
5,486,129 A 1/1996 Sandhu et al.
5,489,233 A 2/1996 Cook et al.
5,499,733 A 3/1996 Litvak
5,559,428 A 9/1996 Li et al.
5,605,760 A 2/1997 Roberts
5,609,511 A 3/1997 Moriyama et al.
5,663,797 A 9/1997 Sandhu
5,672,091 A 9/1997 Takahashi et al.
5,738,574 A 4/1998 Tolles et al.
5,791,969 A 8/1998 Lund
5,791,975 A 8/1998 Cesna et al.
5,807,165 A 9/1998 Uzoh et al.
5,838,447 A 11/1998 Hiyama et al.
5,872,633 A 2/1999 Holzapfel et al.
5,893,796 A 4/1999 Birang et al.
5,921,855 A 7/1999 Osterheld et al.
5,949,927 A 9/1999 Tang
5,964,643 A 10/1999 Birang et al.
6,033,293 A 3/2000 Crevasse et al.
6,045,439 A 4/2000 Birang et al.
6,068,539 A 5/2000 Bajaj et al.
6,093,085 A * 7/2000 Yellitz et al. ..... 451/41
6,135,856 A 10/2000 Tjaden et al.
6,146,248 A 11/2000 Jairath et al.
6,159,073 A 12/2000 Wiswesser et al.
6,179,709 B1 1/2001 Redeker et al.
6,261,168 B1 7/2001 Jensen et al.
6,261,959 B1 7/2001 Travis et al.
6,280,290 B1 8/2001 Birang et al.
6,306,021 B1 10/2001 Masumura et al.
6,328,642 B1 12/2001 Pant et al.
6,331,135 B1 12/2001 Sabde et al.
6,354,915 B1 3/2002 James et al.
6,358,130 B1 3/2002 Freeman et al.
6,368,184 B1 4/2002 Beckage
6,390,891 B1 5/2002 Guha et al.
6,399,501 B2 6/2002 Birang et al.
6,402,591 B1 6/2002 Thornton
6,406,363 B1 6/2002 Xu et al.
6,406,591 B1 6/2002 Beckstrom et al.
6,422,927 B1 7/2002 Zuniga
6,428,394 B1 8/2002 Mooring et al.
6,450,868 B1 9/2002 Zuniga et al.
6,458,014 B1 10/2002 Ihsikawa et al.
6,475,332 B1 11/2002 Boyd et al.
6,482,307 B2 11/2002 Ashjaee et al.
6,488,575 B2 12/2002 Agarwal et al.
6,497,800 B1 12/2002 Talieh et al.
6,497,806 B1 12/2002 Endo
6,517,426 B2 * 2/2003 Lee ..... 451/537
6,520,843 B1 2/2003 Halley
6,524,164 B1 2/2003 Tolles
6,537,133 B1 3/2003 Birang et al.
6,537,144 B1 3/2003 Tsai et al.
6,551,179 B1 4/2003 Halley
6,561,873 B2 5/2003 Tsai et al.
6,561,889 B1 5/2003 Xu et al.
6,569,004 B1 5/2003 Pham
6,572,463 B1 6/2003 Xu et al.
6,572,755 B2 6/2003 Emesh et al.
6,585,579 B2 7/2003 Jensen et al.
6,602,724 B2 8/2003 Redeker et al.
6,612,917 B2 9/2003 Bruxvoort
6,626,740 B2 9/2003 Baker, III et al.
6,632,129 B2 10/2003 Goetz
6,638,143 B2 10/2003 Wang et al.
6,676,717 B1 1/2004 Birang et al.
6,705,934 B1 3/2004 Shiro et al.
6,719,818 B1 4/2004 Birang et al.
6,776,692 B1 8/2004 Zuniga et al.
6,802,955 B2 10/2004 Emesh et al.
6,811,680 B2 11/2004 Chen et al.
6,824,447 B2 11/2004 Takahashi et al.
6,832,950 B2 12/2004 Wright et al.
6,848,974 B2 2/2005 Hasegawa et al.
6,855,034 B2 2/2005 Hasegawa
6,857,945 B1 2/2005 Chen et al.
6,884,153 B2 4/2005 Manens et al.
6,884,156 B2 4/2005 Prasad et al.
6,905,402 B2 6/2005 Allison et al.
6,913,517 B2 7/2005 Prasad
6,924,641 B1 8/2005 Hanawa et al.
6,935,931 B2 8/2005 Prasad
6,960,120 B2 11/2005 Prasad
6,960,521 B2 11/2005 Moon et al.
7,112,121 B2 9/2006 Lee et al.
7,132,070 B2 11/2006 Shih et al.
7,192,340 B2 3/2007 Ono et al.
2001/0005667 A1 6/2001 Tolles et al.
2001/0036746 A1 11/2001 Sato et al.
2002/0004357 A1 1/2002 Baker, III et al.
2002/0020621 A1 2/2002 Uzoh et al.
2002/0077031 A1 6/2002 Johansson et al.
2002/0102853 A1 8/2002 Li et al.
2002/0108861 A1 8/2002 Emesh et al.
2002/0119286 A1 8/2002 Chen et al.
2002/0130049 A1 9/2002 Chen et al.
2002/0164925 A1 11/2002 Swedek et al.
2002/0193054 A1 12/2002 Smith
2002/0193059 A1 12/2002 Freeman et al.
2003/0104768 A1 6/2003 Carlson
2003/0209448 A1 11/2003 Hu et al.
2003/0213703 A1 11/2003 Wang et al.
2003/0220053 A1 11/2003 Manens et al.
2004/0020788 A1 2/2004 Mavliev et al.
2004/0020789 A1 2/2004 Hu et al.
2004/0023495 A1 2/2004 Butterfield et al.
2004/0023610 A1 2/2004 Hu et al.
2004/0082289 A1 4/2004 Butterfield et al.
2004/0121708 A1 6/2004 Hu et al.
2004/0134792 A1 7/2004 Butterfield et al.
2004/0163946 A1 8/2004 Chang et al.
2005/0000801 A1 1/2005 Wang et al.
2005/0064802 A1 3/2005 Wiswesser et al.
2005/0098446 A1 5/2005 Tsai et al.
2005/0173259 A1 8/2005 Mavliev et al.
2007/0015448 A1 1/2007 Swisher et al.
2008/0038999 A1 2/2008 Manens et al.
2008/0057845 A1 3/2008 Prasad

FOREIGN PATENT DOCUMENTS

JP 62-211927 1/1983
JP 03-234467 8/1987
JP 05-138531 9/1987
JP 02-222533 9/1990
JP 05-309558 9/1990
JP 60-037076 10/1991
JP 07-052032 6/1993
JP 09-036072 11/1993
TW 200404648 4/2004
WO WO 93/20976 10/1993
WO WO02/075804 9/2002
WO WO 02/85570 10/2002
WO WO02/085570 10/2002

OTHER PUBLICATIONS

U.S. Appl. No. 11/207,680, filed Aug. 18, 2005, Mavliev et al.

Taiwan Patent Examiner, Official Letter of Pending Patent Application, Apr. 17, 2009, Taiwan Patent Office (office action for Taiwan Patent Application No. 95103206).

China Patent Examiner, Notice on the First OA, Mar. 16, 2009, China Patent Office (office action for Chinese Patent Application No. 200710167020.8).

* cited by examiner

FIG. 1A *Prior Art*

MULTI-LAYER POLISHING PAD FOR LOW-PRESSURE POLISHING

CROSS-REFERENCE TO RELATED APPLICATIONS

This application is a continuation-in-part of U.S. patent application Ser. No. 10/956,617, filed on Oct. 1, 2004, which claims priority to U.S. Provisional Application Ser. No. 60/508,321, filed on Oct. 3, 2003. This application is also a continuation-in-part of U.S. patent application Ser. No. 10/773,868, filed on Feb. 6, 2004 now abandoned. The entire disclosure of each of the above-referenced applications is incorporated by reference.

BACKGROUND

This present invention relates to polishing pads used in during chemical mechanical polishing.

An integrated circuit is typically formed on a substrate by the sequential deposition of conductive, semiconductive or insulative layers on a silicon wafer. One fabrication step involves depositing a filler layer over a non-planar surface, and planarizing the filler layer until the non-planar surface is exposed. For example, a conductive filler layer can be deposited on a patterned insulative layer to fill the trenches or holes in the insulative layer. The filler layer is then polished until the raised pattern of the insulative layer is exposed. After planarization, the portions of the conductive layer remaining between the raised pattern of the insulative layer form vias, plugs and lines that provide conductive paths between thin film circuits on the substrate. In addition, planarization is needed to planarize the substrate surface for photolithography.

Chemical mechanical polishing (CMP) is one accepted method of planarization. This planarization method typically requires that the substrate be mounted on a carrier or polishing head. The exposed surface of the substrate is placed against the polishing surface of a polishing pad, such as a rotating polishing disk or linearly advancing belt. The carrier head provides a controllable load on the substrate to push it against the polishing pad. A polishing liquid, which can include abrasive particles, is supplied to the surface of the polishing pad, and the relative motion between the substrate and polishing pad results in planarization and polishing.

Conventional polishing pads include "standard" pads and fixed-abrasive pads. A typical standard pad has a polyurethane polishing layer with a durable roughened surface, and can also include a compressible backing layer. In contrast, a fixed-abrasive pad has abrasive particles held in a containment media, and can be supported on a generally incompressible backing layer.

One objective of a chemical mechanical polishing process is to achieve topology uniformity across the substrate. Another object is to achieve polishing uniformity. If different areas on the substrate are polished at different rates, then it is possible for some areas of the substrate to have too much material removed ("overpolishing") or too little material removed ("underpolishing"), which can result in non-uniform topography across the substrate.

SUMMARY

In one aspect, the invention is directed to a polishing pad with a polishing layer and a backing layer secured to the polishing layer. The polishing layer has a polishing surface, a first thickness, a first compressibility, a hardness between about 40 to 80 Shore D, and a thickness non-uniformity. The backing layer has a second thickness and a second compressibility greater than the first compressibility. The first thickness, first compressibility, second thickness and second compressibility are such that the polishing surface deflects, under an applied pressure of 1.5 psi or less, more than the thickness non-uniformity of the polishing layer.

Implementations of the invention can include one or more of the following features. The second thickness may be greater than the first thickness, or about the same as the first thickness. The backing layer may have a hardness between about 1 and 10 Shore A. The backing layer may have second thickness between about 30 and 200 mils, e.g., between about 30 and 90 mils. A plurality of grooves may be formed in the polishing surface. A recess may be formed in a bottom surface of the polishing layer, and an aperture may be formed in the backing layer aligned with the recess. A conductive sheet may be secured to the backing layer on a side opposite the polishing layer. A plurality of holes may be formed through the polishing layer and the backing layer to expose the conductive sheet. A solid light-transmissive portion may be positioned in the polishing layer. An aperture may be formed in the backing layer aligned with the light-transmissive portion. A light-transmissive adhesion layer may be on the side of the backing layer opposite the polishing layer, and the adhesion layer may span the aperture on the backing layer. A fluid-impermeable transparent sheet may be between the backing layer and the polishing layer. An outer edge of the polishing layer may overhang an outer edge of the backing layer. The backing layer may have a product of the second thickness and second compressibility of 2 mils or more, at an applied pressure of 1.5 psi or less. The backing layer may include a polyurethane, polyether or polysilicone foam.

In another aspect, the invention is directed to a polishing pad with a polishing pad having a polishing surface, a solid light-transmissive portion positioned in the polishing layer, a backing layer on a side of the polishing layer opposite the polishing surface, and a light-transmissive adhesion layer on the side of the backing layer opposite the polishing layer. The backing layer has an aperture aligned with the light-transmissive portion, and the light-transmissive adhesion layer spans the aperture on the backing layer.

Implementations of the invention can include one or more of the following features. The adhesion layer may abut the backing layer. The backing layer may be connected directly to the polishing layer by an adhesive. A conductive layer may be on a side of the adhesion layer opposite the backing layer, e.g., the conductive layer may abut the adhesion layer. The backing layer may be more compressible than the polishing layer. The adhesion layer may include a double-sided adhesive tape. The adhesion layer may include a polyethylene terephthalate film. The window may be integrally molded in the polishing layer, or may be secured in an aperture in the polishing layer by an adhesive. A fluid-impermeable transparent sheet may be between the backing layer and the polishing layer.

In another aspect, the invention is directed to a polishing pad with a polishing layer having a polishing surface and a backing layer on a side of the polishing layer opposite the polishing surface. An outer edge of the polishing layer overhangs an outer edge of the backing layer.

Implementations of the invention can include one or more of the following features. The polishing layer and backing layer may be substantially circular, and a diameter of the backing layer may be less than a diameter of the polishing layer. The backing layer may be more compressible than the polishing layer. The outer edge of the polishing layer may overhang the outer edge of the backing layer by about one-quarter inch. The polishing layer and backing layer may be secured by an adhesive.

In another aspect, the invention is directed to a polishing pad that has a polishing layer having a polishing surface, a solid light-transmissive portion positioned in the polishing layer, a backing layer on a side of the polishing layer opposite the polishing surface, a fluid-impermeable transparent sheet between the backing layer and the polishing layer, a light-transmissive adhesion layer on the side of the backing layer opposite the polishing layer, and a conductive layer on a side of the adhesion layer opposite the backing layer. The backing layer has an aperture aligned with the light-transmissive portion, and the transparent sheet spans the solid light-transmissive portion.

In another aspect, the invention is directed to a substrate processing apparatus. The apparatus can include a pad support, a polishing pad according to one of the aspects discussed above, a carrier head to hold a substrate in contact with the polishing pad, a supply of processing fluid, and a motor connected to at least one of the pad support and the carrier head to cause relative motion between the processing pad and the substrate.

Implementations of the invention can include one or more of the following features. The apparatus may include an electrode positioned to contact the substrate, a cathode contacting the processing fluid, and a power supply coupled between the electrode and the cathode to create a bias.

In another aspect, the invention is directed to a method of chemical mechanical processing. The method includes bringing a substrate into contact with a polishing surface of a polishing layer of a polishing pad according to one of the aspects discussed above, supplying a polishing liquid to the polishing surface, creating relative motion between the substrate and the polishing surface, and applying a pressure to the substrate to press the substrate against the polishing pad.

Implementations of the invention can include one or more of the following features. The applied pressure may be 1.5 psi or less, and the polishing surface may deflects more than a thickness non-uniformity of the polishing layer under the applied pressure. Supplying the polishing liquid may include supplying an electrolyte, and the method may further include applying a bias between a cathode exposed to the electrolyte and the substrate.

Any of the various implementations discussed above may also be applicable to any of the various aspects of the invention.

Potential advantages of the invention may include one or more of the following. Polishing uniformity across the substrate may be improved, particularly at low pressures, e.g. below 1.5 or 1.0 psi or 0.8 psi, or even below 0.5 psi or 0.3 psi. Consequently, materials, such as low-k dielectric materials, that require low-pressure polishing to avoid irreversible damage, such as delamination, can be polished with an acceptable degree of uniformity. In addition, the polishing pad can provide good mechanical contact to the substrate surface when the substrate is polished at low down force and/or the substrate is not flat due to internal stress induced by multiple levels of conductive and dielectric layers. The likelihood of premature pad failure, such as premature detachment of the pad from the platen in the region around the window, can be reduced, thereby increasing polishing pad lifetime. The likelihood of polishing liquid seeping into the backing layer can be reduced.

The details of one or more embodiments of the invention are set forth in the accompanying drawings and the description below. Other features, objects, and advantages of the invention will be apparent from the description and drawings, and from the claims.

DESCRIPTION OF DRAWINGS

FIG. 1A is a schematic cross-sectional side view illustrating a conventional polishing pad.

Like reference symbols in the various drawings indicate like elements.

DETAILED DESCRIPTION

As mentioned above, and referring to FIG 1A, a conventional polishing pad 60 can have a polyurethane covering layer 64 with a durable rough polishing surface 66 and a compressible backing layer 62 with about the same thickness as the covering layer. In addition, there may be small variations in the thickness of the covering layer 64, e.g., on the order of a few mils, e.g., about 1-2 mil, across the polishing pad (for clarity, the variations are significantly exaggerated in FIG. 1A).

For example, one polishing pad commercially available from Rodel, Inc., has a covering layer formed of polyurethane with embedded hollow microspheres (IC1000) and a backing layer formed of polyurethane impregnated polyester felt (Suba IV). The covering layer has a thickness of 50 or 80 mils and a hardness of 52-62 on the Shore D scale, whereas the backing layer has a thickness of 50 mils and a hardness of about 61 on the Shore A scale.

Figure 1B:
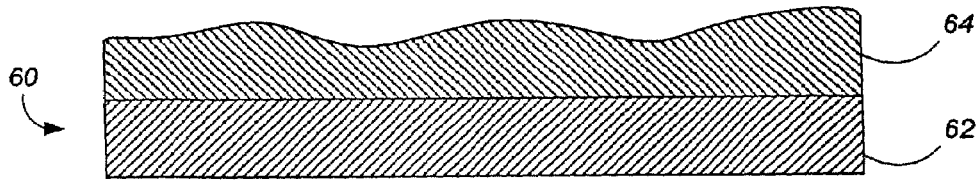
FIG. 1B is a schematic cross-sectional side view illustrating a substrate in contact with the polishing pad of FIG. 1A.
Figure 1B:
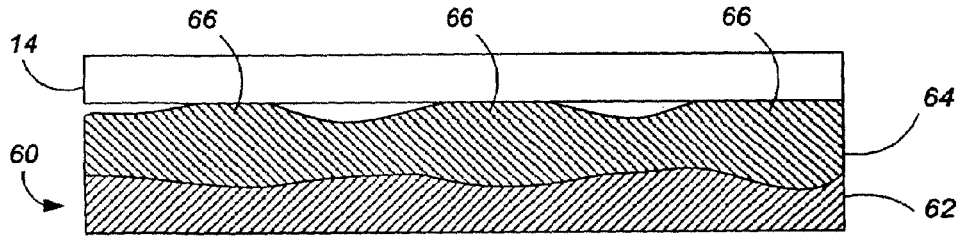

Unfortunately, the conventional polishing pad can result in unacceptable polishing uniformity at low pressures, e.g., below 1.5 psi or below 1.0 psi, and particularly at very low pressures, e.g., below 0.5 psi. Without being limited to any particular theory, it may be that the dimensions and physical properties of the standard polishing pad are such that, at low polishing pressures, the backing layer remains rigid enough that the downward pressure of the substrate 14 is not sufficient to completely "flatten out" the covering layer. Consequently, as shown in FIG. 1B, any thickness variation in the covering layer 64 results in pressure being transmitted to the substrate in only the thick portions 66 of the covering layer 64, thus causing the non-uniformity in the polishing rate. In addition, a typical substrate is not perfectly flat due to internal stresses, and the applied load may not be great enough to conform the substrate against the polishing pad so as to create uniform contact between the substrate and the polishing surface.

In contrast to these conventional polishing pads, one implementation of the polishing pad of the present invention has a thinner covering layer and a thicker and more compressible backing layer. Again without being limited to any particular theory, the reduced thickness of the covering layer may make it easier to deflect. In addition, the increased thickness and compressibility of the backing layer may make the covering layer easier to deflect. As a result, even at very low polishing pressures, the covering layer can be conformed to the substrate (for example, if the substrate is flat as shown then the covering layer will be flattened out, whereas if the substrate is warped then the covering layer will conform to have the same shape) so that thickness variations in the covering layer need not adversely impact the polishing uniformity, and so that good mechanical contact is created between the substrate and the polishing surface so as to provide a high polishing rate and a shorter polishing time.

Figure 2:
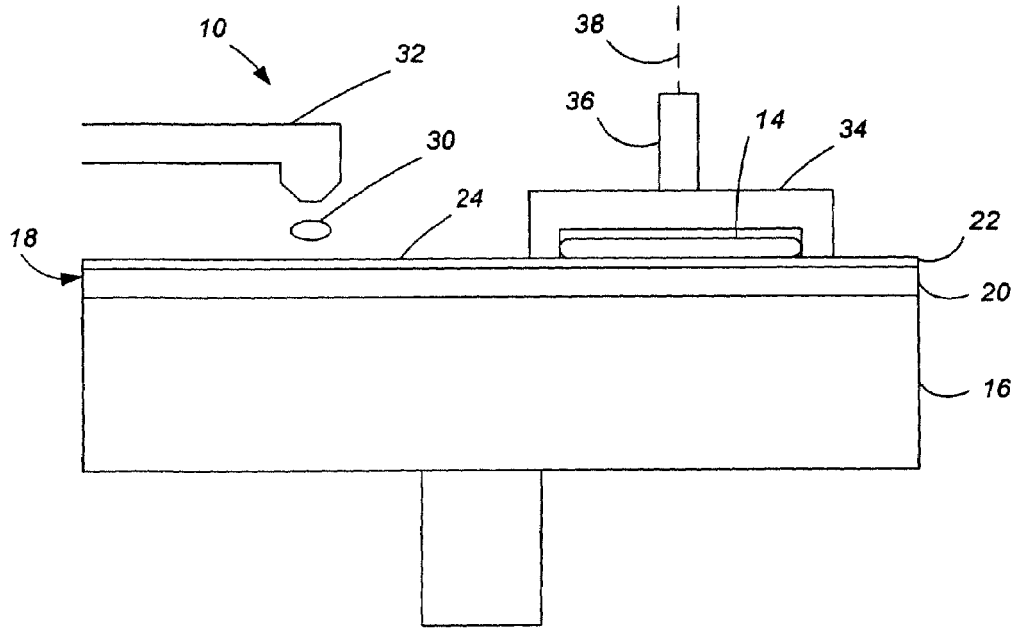
FIG. 2 is a schematic side view, partially cross-sectional, of a chemical mechanical polishing station.

Turning now to FIG. 2, one or more substrates 14 can be polished at a polishing station 10 of a CMP apparatus. A description of a suitable polishing apparatus can be found in U.S. Pat. No. 5,738,574, the entire disclosure of which is incorporated herein by reference.

The polishing station 10 includes a rotatable platen 16 on which is placed a polishing pad 18. As described below, the polishing pad 18 is a two-layer polishing pad with a soft backing layer 20 and a hard durable outer layer 22 with a substantially uniform composition. The durable outer covering layer 22 provides a polishing surface 24. The polishing station can also include a pad conditioner apparatus to maintain the condition of the surface of the polishing pad so that it will effectively polish substrates.

During a polishing step, a polishing fluid 30, e.g., a slurry, can be supplied to the surface of polishing pad 18 by a slurry supply port or combined slurry/rinse arm 32. Slurry 30 can contain abrasive particles, a pH adjuster, or chemically active components.

The substrate 14 is held against the polishing pad 18 by a carrier head 34. The carrier head 34 is suspended from a support structure, such as a carousel, and is connected by a carrier drive shaft 36 to a carrier head rotation motor so that the carrier head can rotate about an axis 38.

Figure 3A:
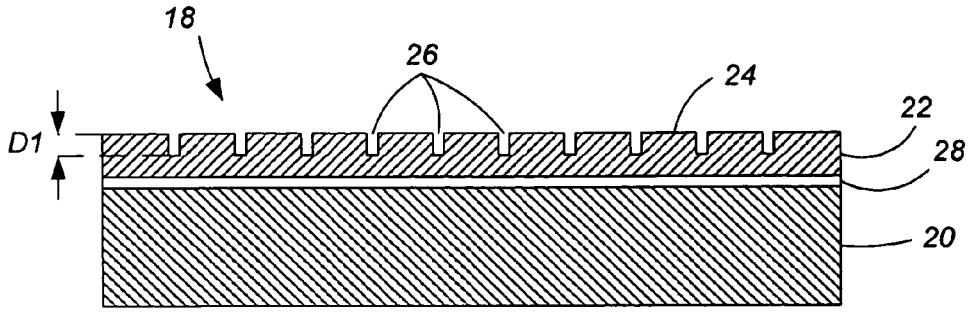
FIG. 3A is a schematic cross-sectional side view illustrating the polishing pad of FIG. 2.

Referring to FIG. 3A, the covering layer 22 of the polishing pad 18 is a relative durable and hard polishing material that is inert in the polishing process, e.g., a cast polyurethane. For example, the covering layer 22 can have a hardness of about 30 to 80, e.g., 40 to 80, e.g., 50 to 65, on the Shore D scale. The polishing surface 24 of the covering layer 22 can have rough surface texture, e.g., hollow microspheres can be embedded in the polyurethane so that when the covering layer is skived from a cast polyurethane block, the microspheres at the exposed surface are ruptured to provide a pitted and rough surface texture.

The covering layer 22 is thin, e.g., less than 50 mils, such as 40 mils or less, or 25 mils or less, or 20 mils or less, or 15 mils or less. In general, the covering layer 22 is as thin as possible, subject to manufacturability. However, the conditioning process tends to wear away the cover layer. Therefore, a thickness of the covering layer can be selected to provide the polishing pad with a useful lifetime, e.g., 3000 polishing and conditioning cycles. For example, the covering layer can have a thickness of 5 to 10 mils. A thickness between about 5 and 20 mils should be appropriate. There may be thickness non-uniformities across the pad of about 1-3 mils, although larger non-uniformities are possible (these non-uniformities refer to the global variations in thickness across the polishing pad caused by the pad fabrication process, rather than discrete thickness variations at a small scale (e.g., less than 100 mils), such as grooves, perforations, or surface roughness).

Optionally, at least a portion of the polishing surface 24 can include a plurality of grooves 26 formed therein for carrying slurry. The grooves may be of nearly any pattern, such as concentric circles, straight lines, a cross-hatched, spirals, and the like. The grooves 26 can extend through about 20-80%, e.g., 25%, of the thickness of the covering layer 22. For example, in a polishing pad having an covering layer 22 that is 20 mils thick, the grooves 26 can have a depth D1 of about 5 mils.

The backing layer 20 is a compressible material that is softer and more compressible than the covering layer 22. For example, the backing layer can be an open-cell or a closed-cell foam, such as polyurethane, polyether or polysilicone with voids, so that under pressure the cells collapse and the backing layer compresses. It is permissible for the material of the backing layer 20 to be laterally displaced under pressure from the substrate. The backing layer 20 can have a hardness of 20 or less on the Shore A scale, e.g., 12 or less, e.g., between 1 and 10 Shore A, e.g., 5 or less.

As mentioned above, the backing layer 20 should be more compressible than the covering layer 22. Compressibility may be measured as a percentage thickness change at a given pressure. For example, under a pressure of about 0.5 psi, the backing layer 20 can undergo about 3% compression. A suitable material for the backing layer is PORON 4701-30 from Rogers Corporation, in Rogers, Conn. (PORON is a trademark of Rogers Corporation).

In addition, the backing layer 20 is thick, e.g., 90 mils or more. For example, the backing layer may be about 95 to 500 mils thick, such as 95 to 200 mils, or 95 to 150 mils, or 95 to 125 mils. In particular, the backing layer 20 may be about 2 to 15 times as thick as the covering layer 22, e.g., 4.5 to 8 times as thick (particularly for a 20 mil thick covering layer).

In general, the thickness of the backing layer 20 is selected to ensure that, given the compressibility of the backing layer 20 and the rigidity of the covering layer 22, the covering layer will deflect at very low pressures, e.g., pressures of 0.5 psi or less, an amount at least equal to any non-uniformity in the thickness of the covering layer, e.g., a few mils, e.g., about 2 mil (the non-uniformities are not shown in FIG. 3A). For example, a 100 mil thick backing layer should have a compression of at least 2% at 0.5 psi, whereas a 200 mil thick backing layer should have a compression of at least 1% at 0.5 psi.

Moreover, the backing layer should be sufficiently compressible that at the operating pressures of interest, e.g., at 1.5 psi to 0.1 psi, the polishing pad is below the maximum compressibility of the polishing pad. The backing layer can have a maximum compressibility greater than 10%, or greater than 20%. In one implementation, the backing layer can have a compressibility of 25% at pressures of 3 to 8 psi, with a maximum compressibility that is even higher.

The backing layer can have a compression force deflection range of 1 to 10 psi (0.2 inches strain rate force at 25% deflection).

In brief, at pressures of 1.5 psi or below (and possibly at 1.0 psi or below, 0.8 psi or below, or 0.5 psi or below, or 0.3 psi or below), the backing layer can have a product of the compressibility and thickness (C-D) that is greater than the non-uniformities in thickness of the cover layer. For example, at pressures of 0.8 psi or below (and possibly at 0.5 psi or below), the backing layer can have a product of the compressibility and thickness (C-D) of a few mils, e.g., 2 mils, or more (and possibly 3 mils or more).

Hydrostatic modulus K may be measured as applied pressure (P) divided volumetric strain ($\Delta V/V$), i.e., $K=PV/\Delta V$. Assuming that the backing layer undergoes pure compression (i.e., material is not displaced laterally under the applied pressure), then the hydrostatic modulus K equals the applied pressure divided by the compression ($\Delta D/D$). Thus, assuming that the backing layer undergoes at least 2% pure compression at 0.5 psi, the backing layer would have a compressibility modulus K of 25 or less. On the other hand, if even lower pressures are to be use, e.g., pressures of 0.1 psi, then the backing layer 20 should have a compressibility modulus of 5 or less. The backing layer may have a compressibility modulus K of 50 psi or less per psi of applied pressure in the range of 0.1 to 1.0 psi. Of course, if the material of the backing layer does undergo lateral displacement under compression, then the volumetric strain will be somewhat less than the compression, so the hydrostatic modulus may be somewhat higher.

Figure 3B:
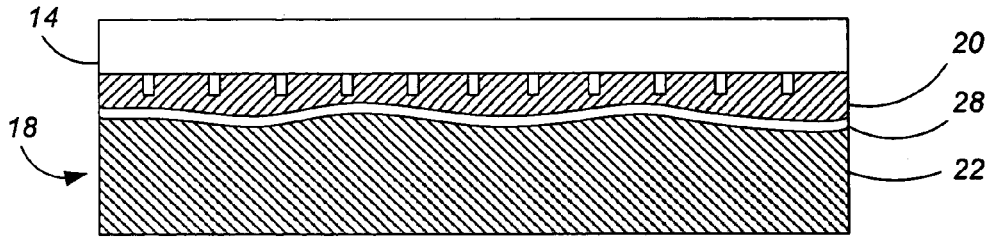
FIG. 3B is a schematic cross-sectional side view illustrating a substrate in contact with the polishing pad of FIG. 3A.

Referring to FIG. 3B, and without being limited to any particular theory, this configuration permits the downward force from the substrate to "flatten out" the covering layer at low pressures, even at pressures of 0.5 psi or less, such as 0.3 psi or less, such as 0.1 psi, and thus substantially compensate for the thickness non-uniformity of the polishing layer and for warp in the substrate. For example, as illustrated, the variations in thickness of the covering layer 22 are absorbed by the compression of the backing layer 20 (for clarity, the variations are significantly exaggerated in FIG. 3A), so that the polishing surface remains in substantially uniform contact with the substantially planar substrate across the substrate surface. As a result, a uniform pressure can be applied to the substrate, thereby improving polishing uniformity during low pressure polishing. Consequently, materials, such as low-k dielectric materials, that require low-pressure polishing to avoid damage, such as delamination, can be polished with an acceptable degree of uniformity.

In one implementation, the covering layer 22 can be manufactured, e.g., by a molding process, with grooves preformed in the upper surface of the covering layer. In a molding process, e.g., injection molding or compression molding, the pad material cures or sets in a mold that has indentations that form the grooves recess. Alternatively, the covering layer 22 can be manufactured by a more conventional technique, e.g., by skiving a thin sheet of pad material from a cast block. The grooves can then be formed by machining or milling the top surface of the covering layer, respectively.

Once the backing layer 20 and covering layer 22 have been manufactured, they can be secured, e.g., with a thin adhesive layer 28, such as a pressure-sensitive adhesive.

Figure 3C:
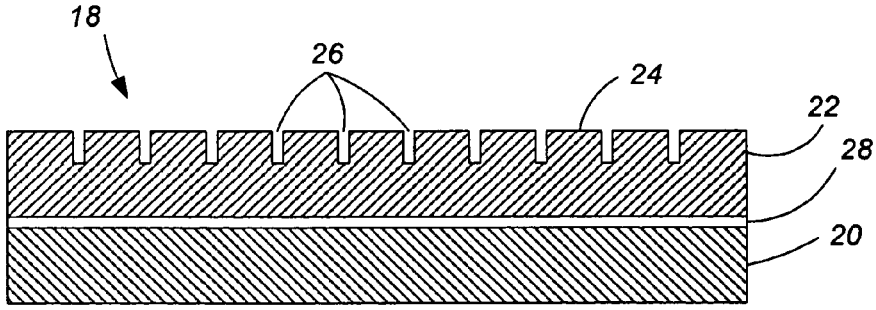
FIG. 3C is a schematic cross-sectional side view illustrating another implementation of the polishing pad in which the covering layer and backing layer have about the same thickness.

Referring to FIG. 3C, in another implementation, the backing layer is the same thickness or is thinner than the covering layer, but is softer and more compressible than the covering layer. In particular, the backing layer can be sufficiently compressible to provide the same functionality as the polishing pad discussed with reference to FIG. 3A. For example, the covering layer will deflect at very low pressures an amount at least equal to any non-uniformity in the thickness of the covering layer (the non-uniformities are not shown in FIG. 3C). In brief, at pressures of 1.5 psi or below (and possibly at 1.0 psi or below, or 0.8 psi or below, or 0.5 psi or below, or 0.3 psi or below), the backing layer can have a product of the compressibility and thickness (C-D) that is greater than the non-uniformities in thickness of the cover layer, for example a few mils, e.g., about 2 mil. For example, under a pressure of about 0.5 psi, the backing layer 20 can undergo about 1% to 30% compression, e.g., 3% compression.

For example, the covering layer 22 can have a hardness of about 30 to 80, e.g., 50 to 65, on the Shore D scale, and can have a thickness between about 30 and 90 mils, e.g., 50 or 80 mils. The backing layer can be an open-cell foam or a closed-cell foam, such as polyurethane, polyether or polysilicone with voids. The backing layer 20 can have a hardness of 20 or less on the Shore A scale, e.g., 12 or less, e.g., between 1 and 10 Shore A, e.g., 5 or less, and can have a thickness that is about the same or less than that of the cover layer, e.g., 30 to 90 mils, e.g., 50 mils.

Figure 3D:
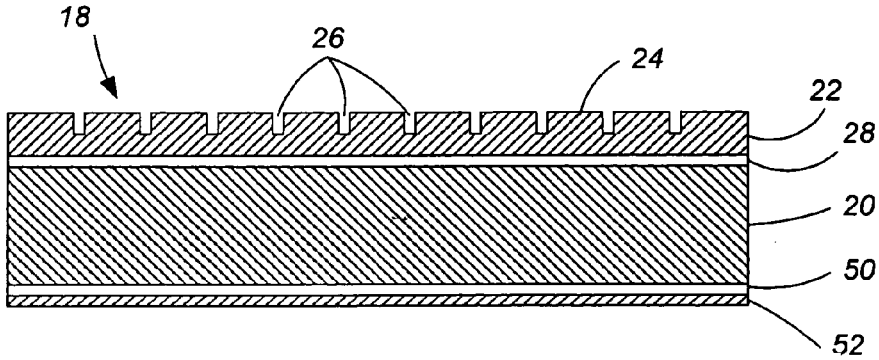
FIG. 3D is a schematic cross-sectional side view illustrating another implementation of the polishing pad in which an adhesive layer and a liner are attached to the backing layer.

In use, the polishing pad 18 can be secured to the platen with an adhesive layer. Referring to FIG. 3D, a polishing pad otherwise constructed as described with respect to FIG. 3A or 3C can be manufactured with an adhesive layer 50, e.g., a double-sided adhesive tape, e.g., a Mylar sheet coated on both sides with adhesive, covering the bottom of backing layer 20. In addition, a non-adhesive liner 52 may be placed under the adhesive layer 50. The liner 52 is removed prior to attaching the polishing pad 18 to the platen. The adhesive layer 50 can provide additional structural integrity to the polishing pad so that the pad can be removed from the platen as a single unit without tearing the backing layer.

Figure 3E:
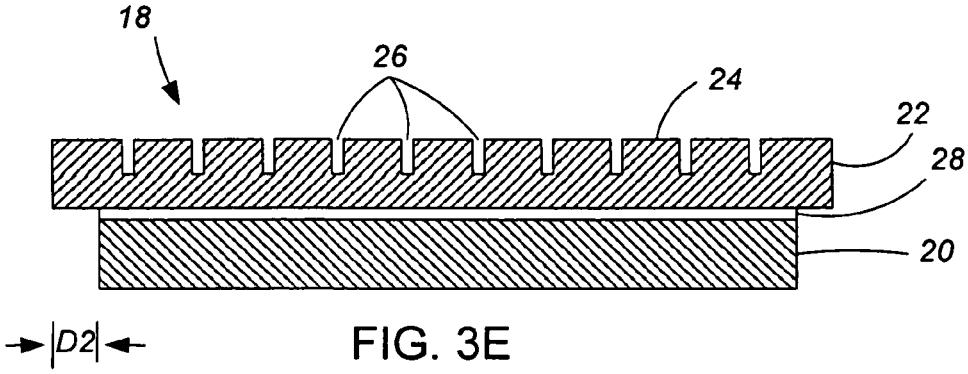
FIG. 3E is a schematic cross-sectional side view illustrating another implementation of the polishing pad in which the covering layer overhangs the backing layer.

Referring to FIG. 3E, in another implementation, which can otherwise be constructed as described with respect to FIGS. 3A, 3C or 3D, the backing layer 20 can have a diameter that is smaller than the diameter of the covering layer 22. For example, the backing layer 20 can have a diameter of 30.0 inches, and the covering layer 22 can have a diameter of 30.5 inches. The outer edge of the backing layer can be evenly recessed by a distance D2 of about 0.25 inches from the outer edge of the cover layer. Having the outer edge of the cover layer 22 overhang the outer edge of the backing layer 20 can help prevent polishing fluid, e.g., deionized water, from entering the backing layer 20 due to capillary action or the like, which could change the compressibility of the backing layer 20 and impact the uniformity of the polishing process.

Figure 4:
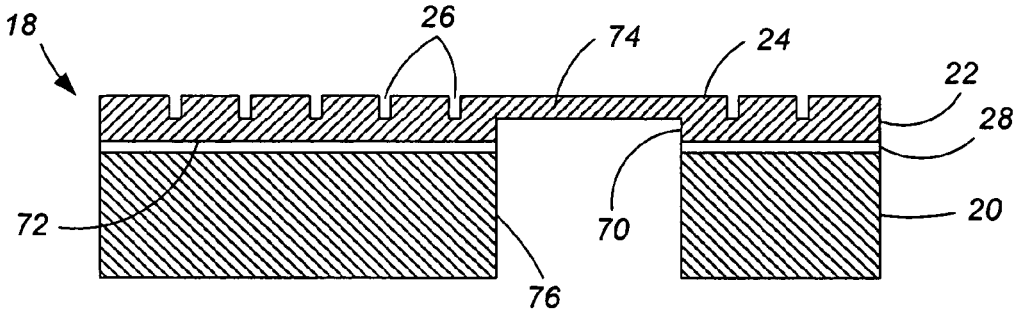
FIG. 4 is a schematic cross-sectional side view illustrating another implementation of the polishing pad in which a recess is formed in the bottom surface of the covering layer.

Referring to FIG. 4, in another implementation, which can otherwise be constructed as described with respect to FIGS. 3A, 3C, 3D or 3E, one or more recesses 70 can be formed in the bottom surface 72 of the covering layer 22 to provide a thin section 74. These recesses 70 can extend through 20 to 80%, e.g., 50%, of the thickness of the covering layer 22. For example, in a polishing pad having a covering layer 22 that is 20 mils thick, the recess 52 can have a depth of about 10 mils, leaving the thin section 74 with a thickness of about 10 mils. In addition, one or more apertures 76 can be formed in the backing layer 20 to permit sensor elements to extend through the backing layer 20 and partially into the covering layer 22.

In this implementation, the grooves 26 do not extend over the thin section 74 in the covering layer 22. Thus, the polishing surface 24 of the polishing pad includes portions with and without grooves, and the indentation is located in one of the portions without grooves. The grooves 26 can be sufficiently deep that they extend to or past the plane defined by the inner surface of the recess 70.

Figure 5:
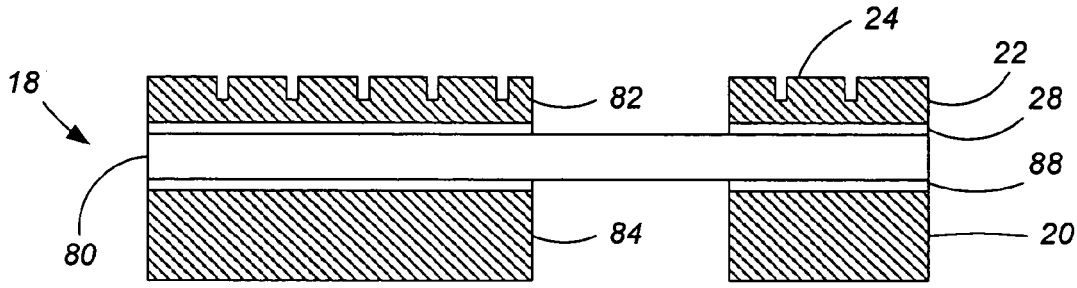
FIG. 5 is a schematic cross-sectional side view illustrating another implementation of the polishing pad including a transparent sheet.

Referring to FIG. 5, in another implementation which can otherwise be constructed as described with respect to FIGS. 3A, 3C-3E or 4, a thin sheet 80 of fluid-impermeable, tear-resistant material, e.g., polyethylene terephthalate, for example, Mylar, is positioned between the backing layer 20 and the covering layer 22. The sheet 80 may be secured to the cover layer 22 by an adhesive layer 28, or the covering layer 22 can be deposited directly on the sheet 80. The sheet 80 may be secured to the backing layer 20 by a thin adhesive layer 88. The sheet 80 can be a transparent material, and aligned portions 82 and 84 of the covering layer 22 and backing layer 20, respectively, can be removed to provide an optical port through the polishing pad.

Alternatively, a window could be formed in the polishing pad without use of the transparent sheet. For example, a solid transparent portion can be formed in the covering layer 22, and an aperture can be formed in the backing layer 20 that is aligned with the solid transparent portion. The transparent portion can be formed by cutting an aperture in the covering layer 22 and securing a transparent plug with an adhesive. Alternatively, the transparent portion can be formed by placing an insert of transparent material in a liquid pad material, curing the liquid pad material so that the insert is integrally molded into the block of solidified pad, and then skiving off the covering layer from the block.

In both these implementations, the adhesive layer 50 can be removed from the region of the optical port or window.

In addition, instead of being removed from the region of the optical port or window, the adhesive layer 50 can be substantially transparent and can span the optical port. For example, referring to FIG. 6A, the polishing pad 18 can include a solid transparent portion 56 that is integrally molded into the covering layer or is held by adhesive in an aperture in the covering layer. An aperture 58 is formed in the backing layer 20 aligned with the solid transparent portion 56. Assuming that the transparent portion is secured by adhesive, the edges of the transparent portion 56 can project over and rest on a rim of the backing layer 20 around the aperture 58 and be secured to the backing layer 20 by an adhesive 59, which can be part of the adhesive 28. On the other hand, if the transparent 56 portion is integrally molded into the covering layer 22, then adhesive 59 is not needed and aperture 58 can be the same size or a different size than the transparent portion. This implementation can otherwise include the features described with respect to any of FIGS. 3A, 3C-3E and 4.

The adhesive layer 50 spans the bottom surface of the backing layer 20, including the aperture 58. The adhesive layer can be a double-sided adhesive tape, such a thin, e.g., 2 mil thick, polyethylene terephthalate sheet coated on both sides with adhesive. To manufacture the polishing pad shown in FIG. 6A the aperture can be formed in the backing layer 20 before the adhesive layer 50 is applied to the bottom surface of the polishing pad. The aperture can be formed in the backing layer 20 before or after the backing layer 20 is secured to the covering layer 22.

Figure 6A:
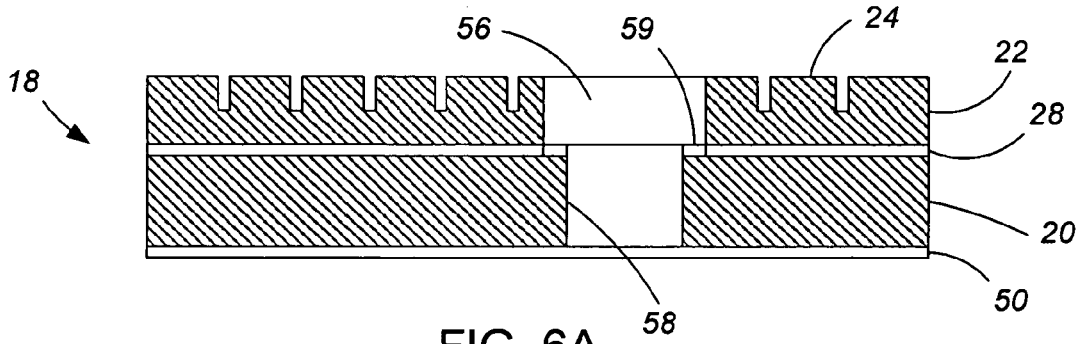
FIG. 6A is a schematic cross-sectional side view illustrating another implementation of the polishing pad including a window and an adhesive layer that spans the window.
Figure 6B:
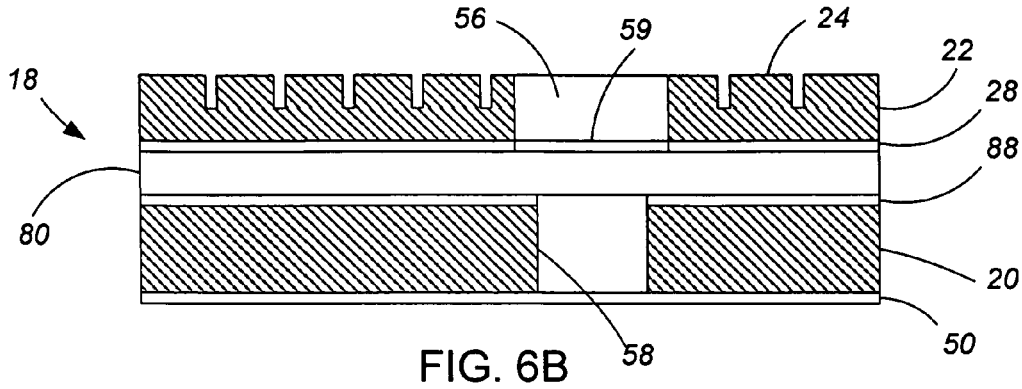
FIG. 6B is a schematic cross-sectional side view illustrating another implementation of the polishing pad including a window, an adhesive layer that spans the window, and a transparent sheet.

A potential advantage of having the adhesive layer 50 span the aperture 58 is reduced likelihood of failure of the window and consequently increased lifetime of the polishing pad. Without being limited to any particular theory, if the adhesive layer 50 does not span the aperture 58, then adhesion of the polishing pad to the platen around the window is reduced, such that cycling of pressure during substrate loading and unloading from the pad can cause failure of the attachment of the polishing pad to the platen around the window, thus causing the portion of the pad around the window to distort and create polishing nonuniformities. In contrast, the adhesive layer 50 spanning the window reinforces adhesion to the platen surface, thereby reducing the likelihood of pad failure. Optionally, as shown in FIG. 6B, a thin sheet 80 of fluid-impermeable, tear-resistant material, such as polyethylene terephthalate, can be positioned between the backing layer 20 and the covering layer 22 with the solid transparent portion 56. The transparent portion 56 can be integrally molded in the cover layer 22, or can be a separate transparent element adhesively secured to the fluid-impermeable sheet 80. The transparent portion 56 can be adhesively secured to the fluid-impermeable sheet 80 by adhesive 59, which can be the same material as the adhesive layer 28 or a different material. If the transparent portion 56 is integrally molded in the cover layer, the adhesive 59 can optionally be removed. In addition, the portion of the adhesive layer 88 above the aperture 58 can be removed or can remain in place.

Figure 7:
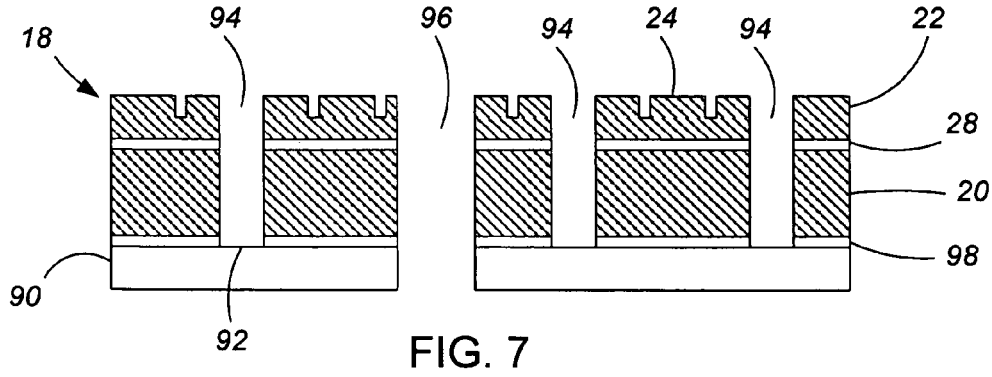
FIG. 7 is a schematic cross-sectional side view illustrating another implementation of the polishing pad including a conductive layer.

Referring to FIG. 7, in another implementation which can otherwise be constructed as described with respect to any of FIGS. 3A-5, a conductive layer 90, e.g., a thin metal layer metal, such as stainless steel, e.g., SST 410, is secured to the bottom surface of the backing layer 22, e.g., with an adhesive layer 98. The metal layer 90 may also be magnetic. A plurality of perforations 94 extend through both the cover layer 22 and the backing layer 20 to expose the top surface 92 of the metal layer. In addition, one or more holes 96 extend through the cover layer 22, backing layer 20 and metal layer 90, to permit electrodes secured to the platen to project through the polishing pad and contact the substrate.

Figure 8:
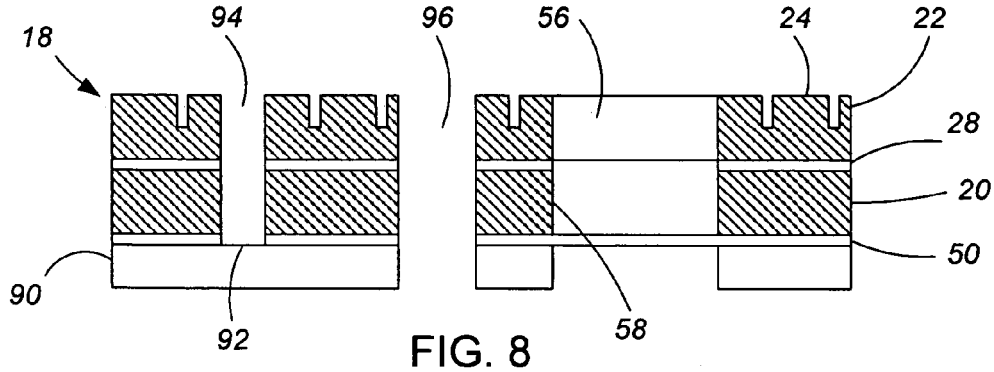
FIG. 8 is a schematic cross-sectional side view illustrating another implementation of the polishing pad including a window and a conductive layer.

Referring to FIG. 8, if the polishing pad includes a conductive layer 90 as described with reference to FIG. 7 and an adhesive layer 50 spanning a window as described with reference to FIG. 6A, then the conductive layer 90 can be positioned below the adhesive layer 50. In addition, apertures can be formed in the adhesive layer 50 in the perforations 94 to expose the top surface 92 of the metal layer. FIG. 8 illustrates an implementation in which the transparent 56 portion is integrally molded into the covering layer 22 and aperture 58 is the same dimensions as the transparent portion.

Figure 9:
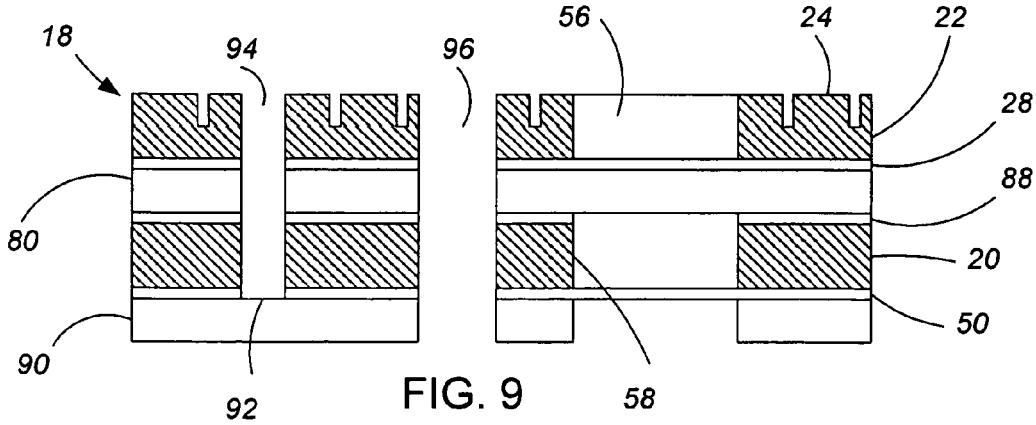
FIG. 9 is a schematic cross-sectional side view illustrating another implementation of the polishing pad including a window, a transparent sheet, and a conductive layer.

Referring to FIG. 9, if the polishing pad includes a conductive layer 90 as described with reference to FIG. 7, and an adhesive layer 50 spanning a window and a transparent sheet as described with reference to FIG. 6B, then the conductive layer 90 can be positioned below the adhesive layer 50. In addition, apertures can be formed in the adhesive layers 50, 28 and 88 and the transparent sheet 80 in the perforations 94 to expose the top surface 92 of the metal layer.

The polishing pads of FIGS. 7-9 (which can also use the various features described with respect to FIGS. 3A-6B in addition or in alternative to the features illustrated) may be used for electrochemical processing, such as electrochemical mechanical polishing (ECMP) or simultaneous electrochemical deposition and polishing, in addition to chemical mechanical polishing.

In electrochemical mechanical polishing, conductive material, such as copper, is removed from the substrate surface by electrochemical dissolution while the substrate surface is concurrently polished. The substrate surface is placed in an electrolyte (which also serves as the polishing fluid), and a bias is applied between the substrate and a cathode that is in contact with the electrolyte. The ECMP can be performed at low or very low pressures, such as less than 1 psi, such 0.8 psi or less, or 0.5 psi or less, or 0.3 psi or less.

For example, referring to FIGS. 7-9, the metal sheet 90 can be connected to a first electrode to serve as the cathode (the holes 94 provide access for the electrolyte to the metal sheet 90), and a second electrode can extend through the aperture 96 to contact the substrate so that the substrate serve as an anode.

In electrochemical deposition, the bias voltage is reversed, so that the substrate surface becomes the cathode, the electrode in contact with the electrolyte becomes the anode, and conductive material is electrodeposited onto the substrate. If this is performed while the substrate is contacting a moving processing pad at low pressure, then material will be preferentially deposited into any trenches in the dielectric layer.

A number of embodiments of the invention have been described. Nevertheless, it will be understood that various modifications may be made without departing from the spirit and scope of the invention.

For example, an adhesive layer can be applied to the bottom surface of the polishing pad to secure the pad to the platen, and the adhesive layer can be covered by a removable liner. In implementations using the transparent sheet, the transparent sheet need not span the entire polishing pad; the transparent sheet could be just large enough to span each aperture to seal the window.

Either the polishing pad, or the carrier head, or both can move to provide relative motion between the polishing surface and the substrate. The polishing pad can be a circular (or some other shape) pad secured to the platen, a tape extending between supply and take-up rollers, or a continuous belt. The polishing pad can be affixed on a platen, incrementally advanced over a platen between polishing operations, or driven continuously over the platen during polishing. The pad can be secured to the platen during polishing, or there could be a fluid bearing between the platen and polishing pad during polishing. In addition, although terms of vertical positioning are used, it should be understood that the polishing surface and substrate could be held upside down, in a vertical orientation, or in some other orientation.

Accordingly, other embodiments are within the scope of the following claims.

What is claimed is:

1. A polishing pad, comprising:

a polishing layer having a polishing surface, a first thickness, a first compressibility, and a hardness between about 40 to 80 Shore D, the polishing layer having a thickness non-uniformity; and a backing layer secured to the polishing layer, the backing layer having a second thickness, and having a second compressibility greater than the first compressibility;

wherein the first thickness, first compressibility, second thickness and second compressibility are such that the polishing surface deflects, under an applied pressure of 1.5 psi or less, more than the thickness non-uniformity of the polishing layer.

2. The polishing pad of claim 1, wherein the second thickness is greater than the first thickness.

3. The polishing pad of claim 1, wherein the second thickness is about the same as the first thickness.

4. The polishing pad of claim 1, wherein the backing layer has a hardness between about 1 and 10 Shore A.

5. The polishing pad of claim 4, wherein the second thickness of the backing layer is between about 30 and 200 mils.

6. The polishing pad of claim 5, wherein the second thickness of the backing layer is between about 30 and 90 mils.

7. The polishing pad of claim 1, further comprising a plurality of grooves formed in the polishing surface.

8. The polishing pad of claim 1, further comprising:

a recess formed in a bottom surface of the polishing layer; and an aperture in the backing layer aligned with the recess.

9. The polishing pad of claim 1, further comprising a conductive sheet secured to the backing layer on a side of the backing layer farther from the polishing layer.

10. The polishing pad of claim 9, further comprising a plurality of holes formed through the polishing layer and the backing layer to expose the conductive sheet.

11. The polishing pad of claim 1, further comprising a solid light-transmissive portion positioned in the polishing layer.

12. The polishing pad of claim 11, wherein an aperture is formed in the backing layer aligned with the light-transmissive portion.

13. The polishing pad of claim 12, further comprising a light-transmissive adhesion layer on a side of the backing layer farther from the polishing layer, the adhesion layer spanning the aperture in the backing layer.

14. The polishing pad of claim 11, further comprising a fluid-impermeable transparent sheet between the backing layer and the polishing layer.

15. The polishing pad of claim 1, wherein an outer edge portion of the polishing layer overhangs an outer edge of the backing layer and a surface of the polishing layer opposite the polishing surface in the outer edge portion is coplanar with a surface of the backing layer facing the polishing layer.

16. The polishing pad of claim 1, wherein the backing layer has a product of the second thickness and second compressibility of 2 mils or more, at an applied pressure of 1.5 psi or less.

17. The polishing pad of claim 1, wherein the backing layer comprises a polyurethane, polyether or polysilicone foam.

18. A polishing pad, comprising:

a polishing layer having a polishing surface;

a solid light-transmissive portion positioned in the polishing layer;

a backing layer secured to the polishing layer on a side of the polishing layer farther from the polishing surface, the backing layer having an aperture aligned with the light-transmissive portion; and a light-transmissive adhesion layer secured to the backing layer on a side of the backing layer farther from the polishing layer, the adhesion layer spanning the aperture in the backing layer.

19. The polishing pad of claim 18, wherein the adhesion layer abuts the backing layer.

20. The polishing pad of claim 19, further comprising a conductive layer that abuts the adhesion layer.

21. The polishing pad of claim 19, wherein the backing layer is connected directly to the polishing layer by an adhesive.

22. The polishing pad of claim 18, further comprising a conductive layer on a side of the adhesion layer farther from the backing layer.

23. The polishing pad of claim 18, wherein the backing layer is more compressible than the polishing layer.

24. The polishing pad of claim 18, wherein the adhesion layer comprises a double-sided adhesive tape.

25. The polishing pad of claim 18, wherein the adhesion layer comprises a polyethylene terephthalate film.

26. The polishing pad of claim 18, wherein the light-transmissive portion is integrally molded in the polishing layer.

27. The polishing pad of claim 18, wherein the light-transmissive portion is secured in an aperture in the polishing layer by an adhesive.

28. The polishing pad of claim 18, further comprising a fluid-impermeable transparent sheet between the backing layer and the polishing layer.

29. A polishing pad, comprising:

a polishing layer having a polishing surface;

a solid light-transmissive portion positioned in the polishing layer;

a backing layer on a side of the polishing layer farther from the polishing surface, the backing layer having an aperture aligned with the light-transmissive portion;

a fluid-impermeable transparent sheet between the backing layer and the polishing layer, the transparent sheet spanning the solid light-transmissive portion;

a light-transmissive adhesion layer on a side of the backing layer farther from the polishing layer, the adhesion layer spanning the aperture in the backing layer; and a conductive layer on a side of the adhesion layer farther from the backing layer.

30. A substrate processing apparatus, comprising:

a pad support;

a processing pad held by the polishing pad support, the processing pad having a covering layer with an outer surface, a first thickness, a first compressibility, a hardness between about 40 to 80 Shore D, and a thickness non-uniformity, and a backing layer secured to the covering layer, the backing layer having a second thickness and having a second compressibility greater than the first compressibility, wherein the first thickness, first compressibility, second thickness and second compressibility are such that the outer surface deflects more than the thickness non-uniformity of the covering layer under an applied pressure of 1.5 psi or less;

a carrier head to hold a substrate in contact with the polishing pad;

a supply of processing fluid; and a motor connected to at least one of the pad support and the carrier head to cause relative motion between the processing pad and the substrate.

31. The apparatus of claim 30, further comprising an electrode positioned to contact the substrate, a cathode contacting the processing fluid, and a power supply coupled between the electrode and the cathode to create a bias.

* * * * *